US006966067B1

(12) United States Patent
Lusk

(10) Patent No.: US 6,966,067 B1
(45) Date of Patent: Nov. 22, 2005

(54) BOATING HELMET

(76) Inventor: Shaun S. Lusk, 3205 Cruiser Dr., Tunnel Hill, GA (US) 30755

( * ) Notice: Subject to any disclaimer, the term of this patent is extended or adjusted under 35 U.S.C. 154(b) by 0 days.

(21) Appl. No.: 10/928,804

(22) Filed: Aug. 27, 2004

(51) Int. Cl.[7] ..... A42B 1/00
(52) U.S. Cl. ..... 2/9; 2/171.3; 2/436; 2/424
(58) Field of Search ..... 2/411, 412, 414, 2/423, 424, 425, 427, 428, 429, 9, 431, 435, 2/436, 410, 171.3, 206; 128/201.27, 201.15, 128/201.17, 201.23, 201.22, 863, 206.22, 128/206.28

(56) References Cited

U.S. PATENT DOCUMENTS

| | | | | |
|---|---|---|---|---|
| 3,763,494 A | | 10/1973 | Nordskog | |
| 3,888,246 A | | 6/1975 | Lauer | |
| 4,704,746 A | | 11/1987 | Nava | |
| 5,093,938 A | * | 3/1992 | Kamata | 2/424 |
| 5,170,510 A | | 12/1992 | Nava | |
| 5,394,566 A | | 3/1995 | Hong | |
| 5,666,671 A | | 9/1997 | Daneshvar | |
| 5,797,146 A | | 8/1998 | Matich | |
| 6,062,688 A | | 5/2000 | Vinas | |
| 6,425,143 B1 | * | 7/2002 | Benedict et al. | 2/424 |
| 2001/0039674 A1 | * | 11/2001 | Shida | 2/414 |
| 2004/0025229 A1 | * | 2/2004 | Takahashi et al. | 2/412 |
| 2005/0036100 A1 | * | 2/2005 | Rice et al. | 351/62 |

* cited by examiner

*Primary Examiner*—Rodney M. Lindsey
(74) *Attorney, Agent, or Firm*—Dale J. Ream

(57) ABSTRACT

A boating helmet includes a liner nested in a shell and a shield attached to the shell. The shell includes a moisture barrier to separate a user's breath from the shield and an air entry chamber to keep inadvertent water from the shield. The liner's inner surface defines warm-air and cool-air channels. When the helmet is worn, the moisture barrier contacts the user's cheeks, separating the areas above and below the moisture barrier. The user's breath enters the warm-air channels, is directed through left and right ear regions, and exits the helmet, warming his face without fogging the shield. Ambient air enters the air entry chamber through a ventilation hole, and inadvertent water is drained. The ambient air is drawn across the shield to keep the shield from fogging, through the cool-air channel, and out of the helmet. The mask further protects a user from precipitation and impact with insects.

19 Claims, 6 Drawing Sheets

BOATING HELMET

BACKGROUND OF THE INVENTION

This invention relates generally to a mask. In particular, the present invention relates to a boating helmet.

Fishing and speed boating popularity are on the rise today, with more people than ever spending time on lakes and rivers. This increasingly crowded arena, combined with the higher speeds of modern boats, raise the specter of accidents. New and better safety equipment is always in demand to enhance the enjoyment of the sport.

Coastal lifejackets, sheltered waters lifejackets, and buoyancy-vests are examples of well-accepted boating safety equipment. These devices are generally effective for their purpose of keeping their user above the water's surface once he has been immersed, and are sometimes effective in warding off hypothermia. Nevertheless, an additional safety device is needed to help prevent immersion. By helping control the user's body temperature and providing him with unclouded vision, many accidents that would have resulted in the user being immersed can be prevented. Further, his comfort and pleasure will be enhanced.

Venting is often a problem in helmets. The human body produces water as a byproduct of metabolizing food, and it gets rid of much of this moisture by exhaling it. When that moisture-laden air contacts a cold surface, the moisture drops out as fog and condensation. Without proper venting, it quickly becomes impossible to see out of a helmet in cold weather.

Various proposals for diverting this moisture-laden air are found in the art. U.S. Pat. No. 3,888,246 and U.S. Pat. No. 5,797,146 disclose devices that deflect a user's breath to reduce condensation on his glasses or shield. Neither provides a temperature-controlled climate for the user, however.

U.S. Pat. No. 4,704,746, U.S. Pat. No. 5,170,510, and U.S. Pat. No. 5,394,566 disclose helmets with air passages provided adjacent the shields inside the helmets, but they do not separate the shield areas from a user's exhalation. They also fail to utilize the user's exhalation to warm his cheeks and ears.

U.S. Pat. No. 5,666,671 discloses a mask using a physical barrier to separate a user's eyes and the mask's vision area from the moisture of his breath. While an adjustable air entrance is included, there are no means for controlling airflow once it is inside the mask. Further, airflow is not provided for defogging the mask's vision area.

While assumably effective for their intended purposes, none of the above proposals provide a boating helmet that helps control a user's body temperature and that provides him with unclouded vision. Many considerations special to boating are simply absent from the prior art. Therefore, it is desirable to have a boating helmet that is comfortable and climate-controlled, provides a shield free of condensation, diverts water that may enter through ventilation holes, protects against impact, protects against precipitation and impact with bugs, protects against hearing loss, floats in water, and is stylish.

SUMMARY OF THE INVENTION

A boating helmet according to the present invention includes a shell, a liner nested in the shell, and a shield attached to the shell. The shell includes a moisture barrier to keep a user's breath from reaching the shield and an air entry chamber to keep water that has inadvertently entered the helmet through a ventilation hole from reaching the shield. The liner includes an inner surface that defines warm and cool air channels.

In use, the boating helmet is placed on a user's head. The moisture barrier contacts the user on his cheeks and nose to seal the area above the moisture barrier from the area below the moisture barrier, thus keeping the user's breath from reaching an inner surface of the shield and preventing fogging. The user's breath enters the warm air channels, where it is directed through left and right ear regions and to a back side of the helmet referred to as the open shell back. Therefore, the heat from the user's breath heats his face while not fogging the shield. Ambient air enters the air entry chamber through the ventilation hole, and inadvertent water is drained. The ambient air is drawn across the inner surface of the shield, through the cool air channel, and to the open shell back. By drawing the ambient air that is free of the water across the inner surface of the shield, the shield is kept from fogging.

Therefore, a general object of this invention is to provide a boating helmet that includes a shield free of condensation.

Another object of this invention is to provide a boating helmet, as aforesaid, that helps control a user's body temperature.

Still another object of this invention is to provide a boating helmet, as aforesaid, that is comfortable and stylish.

Yet another object of this invention is to provide a boating helmet, as aforesaid, that diverts water that may enter through ventilation holes.

A further object of this invention is to provide a boating helmet, as aforesaid, that protects a user against impact.

Another object of this invention is to provide a boating helmet, as aforesaid, that protects the user from precipitation and impact with bugs.

A still further object of this invention is to provide a boating helmet, as aforesaid, that protects the user against hearing loss.

An even further object of this invention is to provide a boating helmet, as aforesaid, that floats in water.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
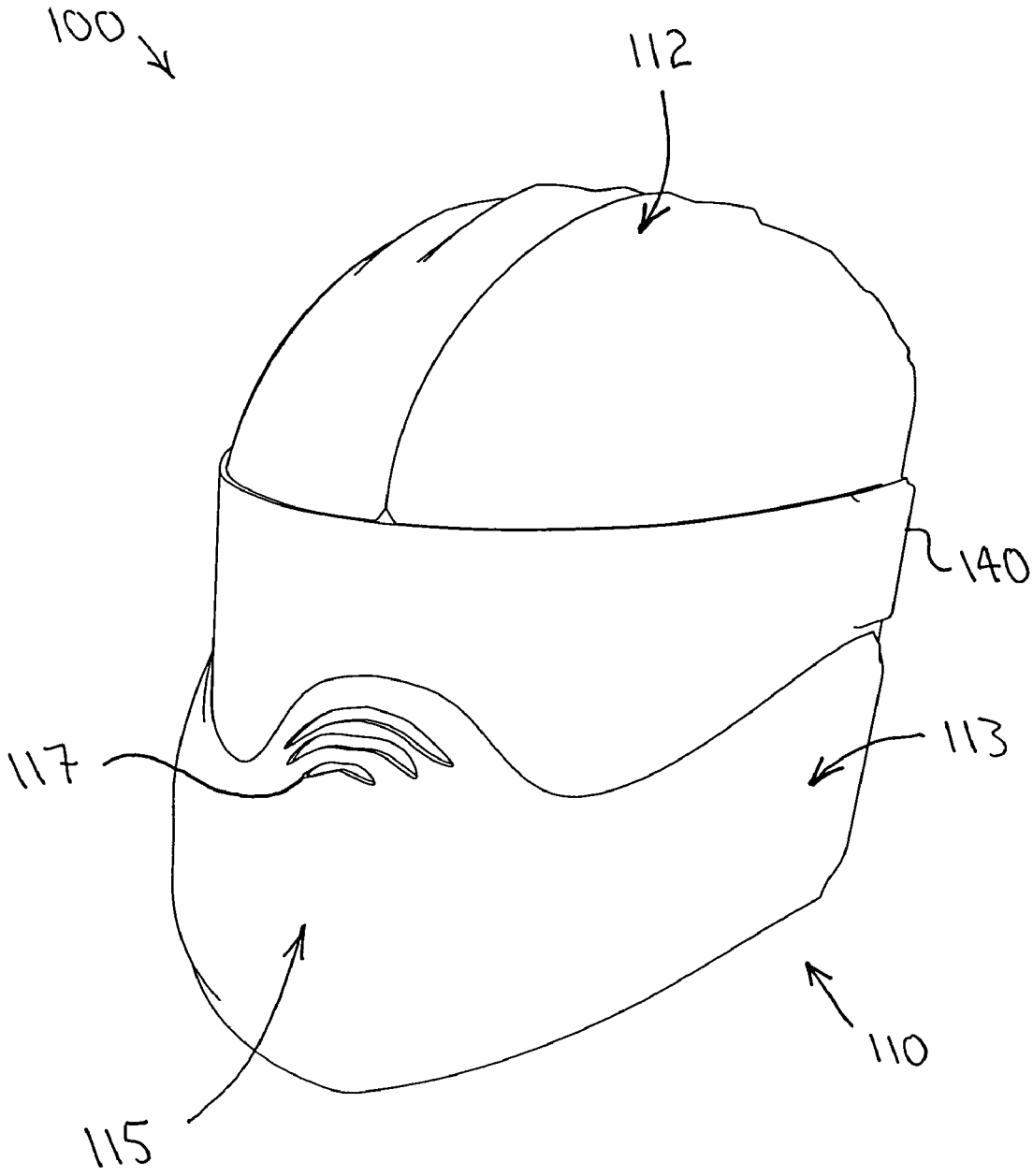
FIG. 1 is a front perspective view of a boating helmet according to the present invention.
Figure 2:
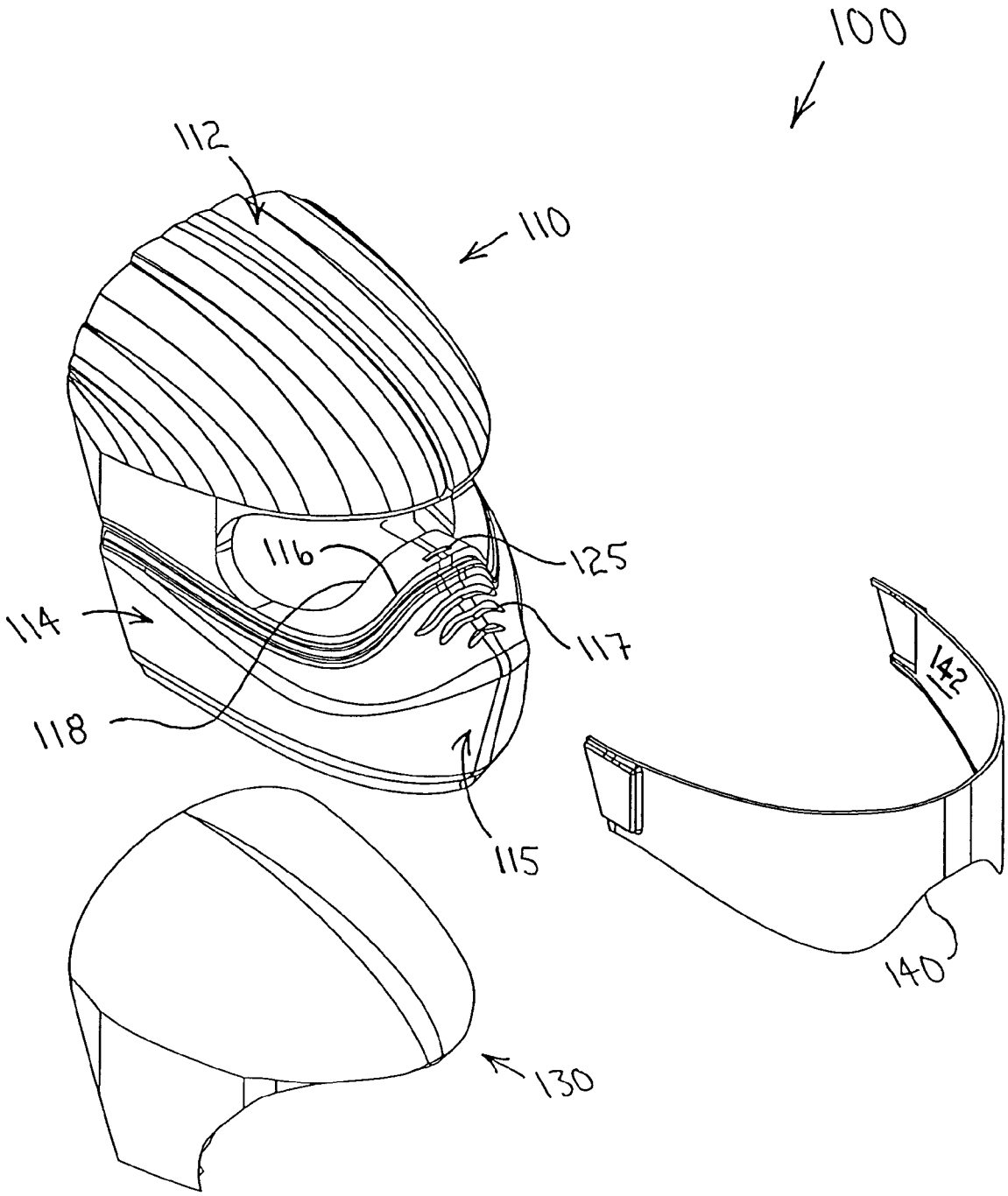
FIG. 2 is an exploded view of the boating helmet as in FIG. 1.
Figure 3:
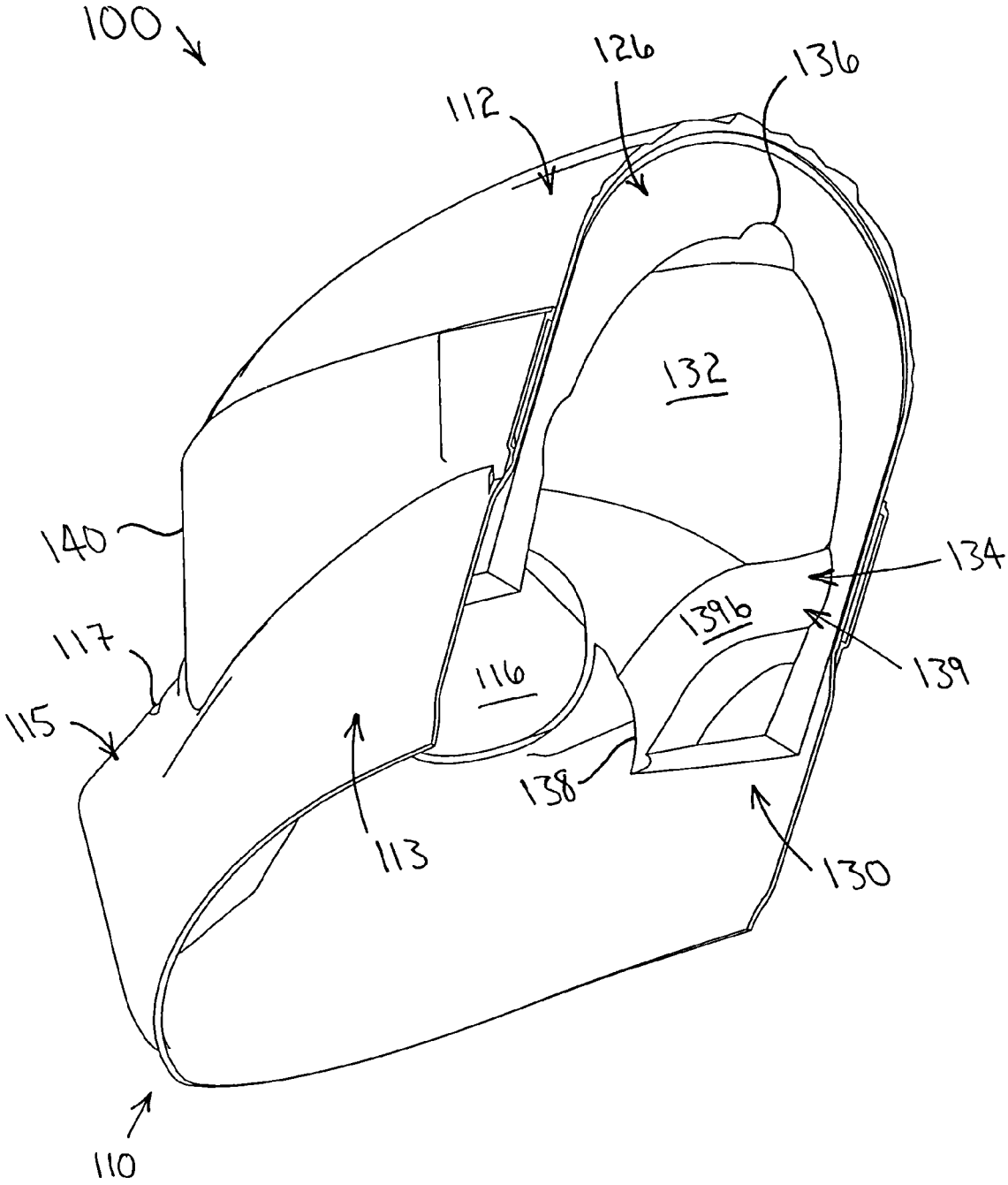
FIG. 3 is a rear perspective view of the boating helmet as in FIG. 1.

A boating helmet according to the present invention will now be described in detail with reference to FIGS. 1 through 6*b* of the accompanying drawings. More particularly, a boating helmet 100 includes a shell 110, a liner 130 nested in the shell 110, and a shield 140 attached to the shell 110 (FIGS. 1 through 3).

Figure 5A:
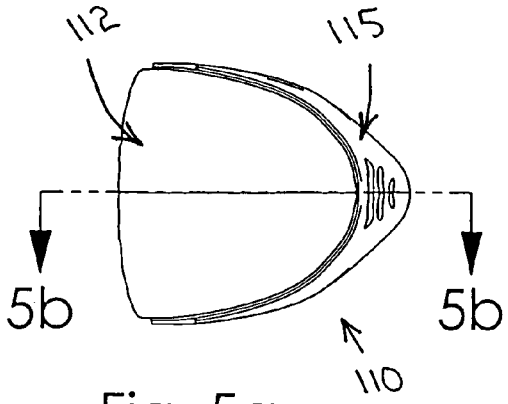
FIG. 5*a* is a top view of the boating helmet as in FIG. 1.
Figure 5B:
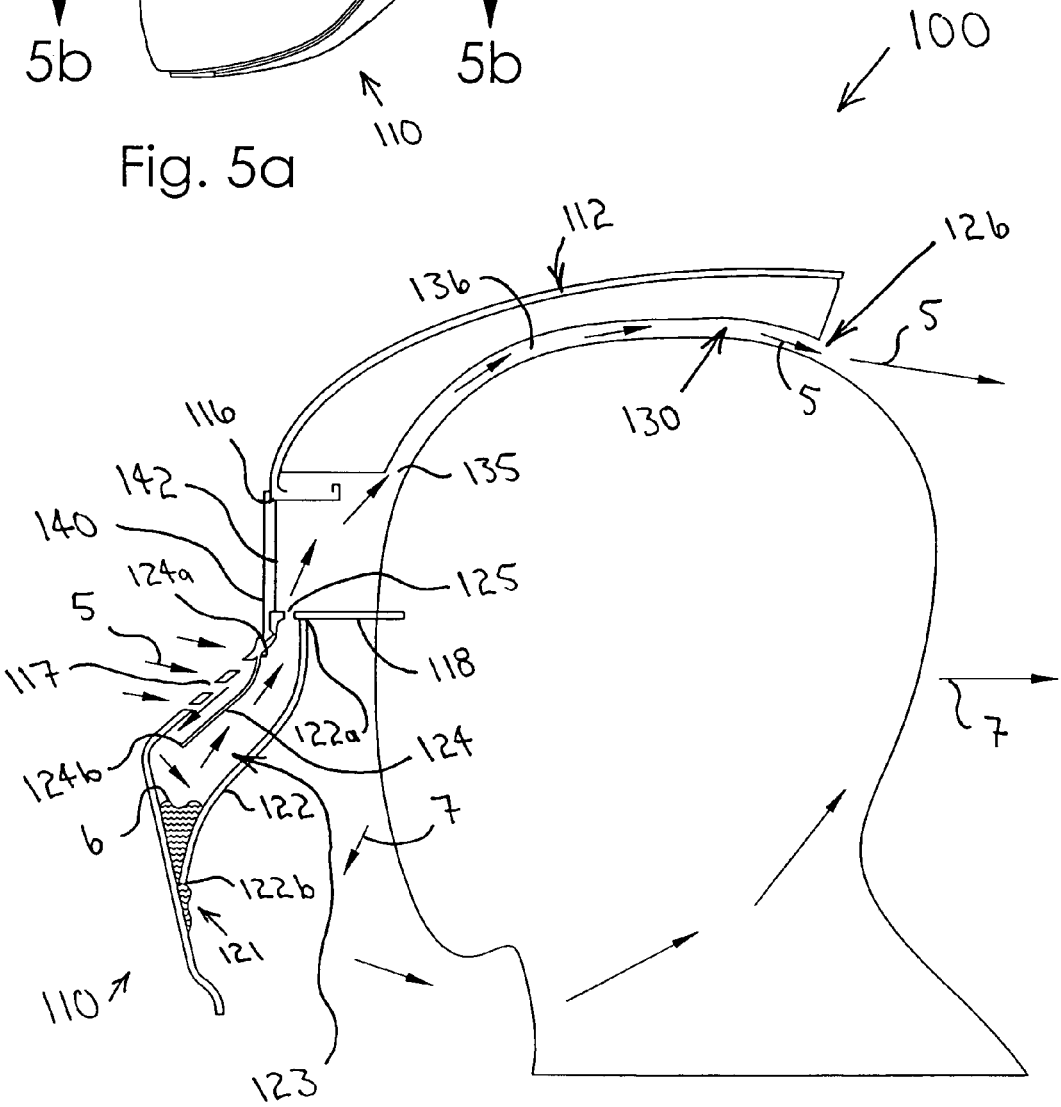
FIG. 5*b* is a sectional view of the boating helmet as in FIG. 1 taken along line 5*b*—5*b* of FIG. 5*a* shown positioned on a user's head and demonstrating paths of airflow.

The shell 110 has a top portion 112, opposed left and right side portions 113, 114, a front portion 115 that defines a shield opening 116 and at least one ventilation hole 117, and a moisture barrier 118 positioned adjacent a lower edge 116*a* of the shield opening 116 and extending inwardly. The moisture barrier 118 defines a cool air opening 125 (FIG. 5*b*). An inner wall 122 of the shell 110 has an upper edge 122*a* connected to the moisture barrier 118 and a lower edge 122*b* proximate the shell front portion 115. The lower edge 122*b* of the inner wall 122 is situated below the ventilation hole 117 and has a configuration forming a water drainage outlet 121. The inner wall 122 and the shell front portion 115 define an air entry chamber 123 for directing incoming ambient air 5 from the ventilation hole 117 to the cool air opening 125 and for directing incoming water 6 from the ventilation hole 117 to the water drainage outlet 121. An intermediate wall 124 of the shell 110 has an upper edge 124*a* connected to the shell front portion 115 above the ventilation hole 117 and a lower edge 124*b* positioned in the air entry chamber 123 below the ventilation hole 117 for keeping incoming water 6 from the ventilation hole 117 from reaching the cool air opening 125. The top portion 112 and the opposed side portions 113, 114 of the shell 110 define an open shell back 126 (FIG. 3).

Figure 4A:
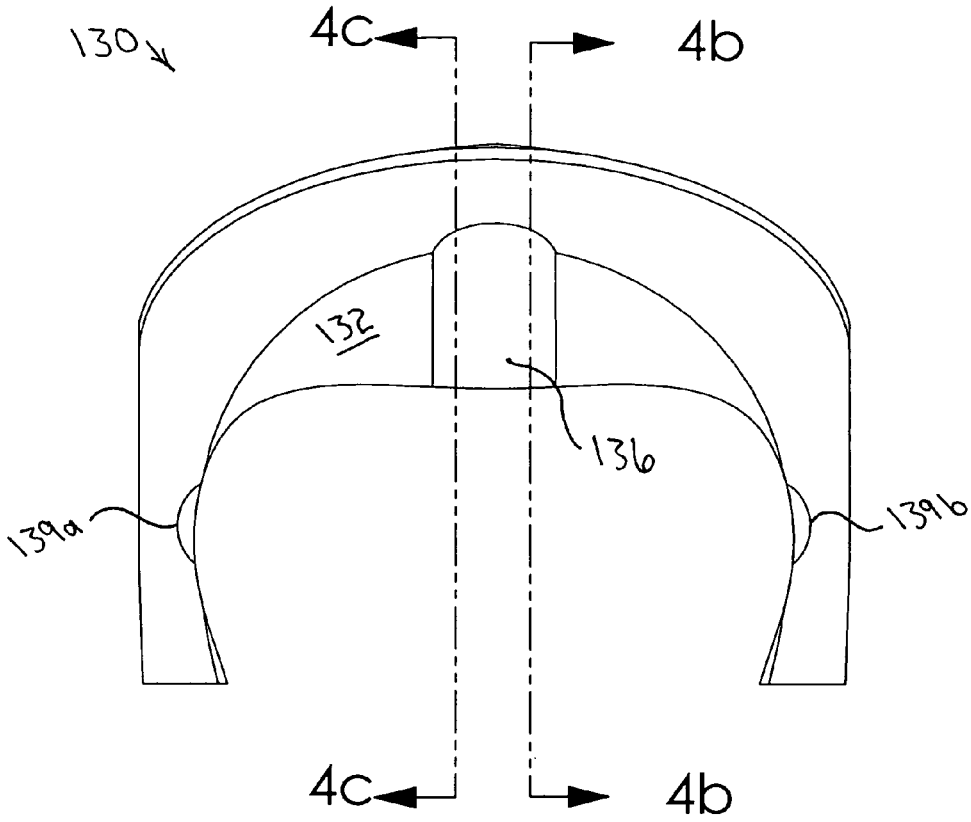
FIG. 4*a* is a rear view of the liner from the boating helmet as in FIG. 1.
Figure 4B:
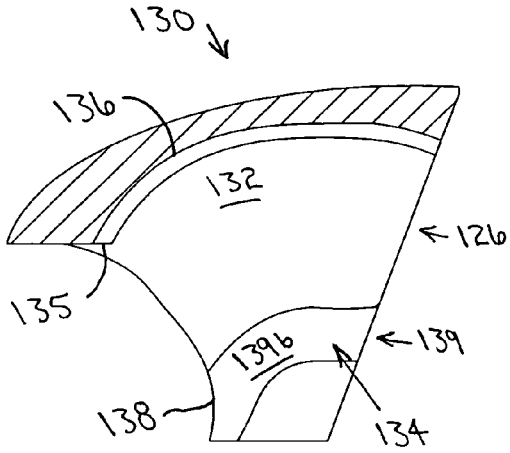
FIG. 4*b* is a sectional view of the liner taken along line 4*b*—4*b* of FIG. 4*a;*
Figure 4C:
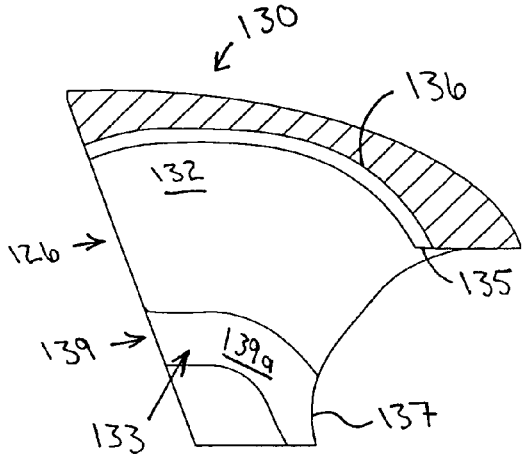
FIG. 4*c* is a sectional view of the liner taken along line 4*c*—4*c* of FIG. 4*a;*

The liner 130 is nested in the shell 110 and includes an inner surface 132 and opposed left and right ear regions 133, 134 (FIGS. 4*a* through 4*c*). The inner surface 132 of the liner 130 defines a cool air channel 136 and at least one warm air channel 139 for directing warm air 7 from a user's breath away from the shield 140. The cool air channel 136 is in communication with the cool air opening 125 for directing the ambient air 5 from the cool air opening 125 across an inner surface 142 of the shield 140 to keep the shield 140 from fogging (FIG. 5*b*).

Preferably, the liner inner surface 132 defines a cool air channel entrance 135 and opposed left and right warm air channel entrances 137, 138 (FIGS. 4*a* through 4*c*). A left warm air channel 139*a* is defined by the liner inner surface 132 and extends from the left warm air channel entrance 137 to the left ear region 133 and from the left ear region 133 to the open shell back 126. A right warm air channel 139*b* is defined by the liner inner surface 132 and extends from the right warm air channel entrance 138 to the right ear region 134 and from the right ear region 134 to the open shell back 126. The cool air channel 136 extends from the cool air channel entrance 135 to the open shell back 126, whereby to draw the ambient air 5 from the cool air opening 125 across the inner surface 142 of the shield 140 and to the open shell back 126 (FIG. 5*b*). The liner 130 may be either permanently or removably nested in the shell 110, and while the liner 130 is preferably constructed of closed cell foam because of the insulation, floatation, and shock absorption properties of closed cell foam, other suitable materials may also be used.

The shield 140 is transparent and is attached to the shell front portion 115 for covering the shield opening 116. The shield 140 may be either removably or permanently attached to the shell front portion 115.

In use, the boating helmet 100 may be placed on a user's head as shown in FIG. 5*b*. The moisture barrier 118 contacts the user on his cheeks and nose and seals the area above the moisture barrier 118 from the area below the moisture barrier 118, thus keeping the user's breath 7 from reaching the inner surface 142 of the shield 140. This helps prevent the shield 140 from fogging. The user's breath 7 enters the left and right warm air channel entrances 137, 138, where it is directed through the left and right ear regions 133, 134, respectively, and to the open shell back 126 by the left and right warm air channels 139*a*, 139*b* (FIGS. 4*a* through 4*c* and 5*b*). Thus, the heat from the user's breath 7 warms his face while not fogging the shield 140.

The ambient air 5 enters the air entry chamber 123 through the ventilation hole 117 (FIG. 5*b*). The intermediate wall 124 forces the ambient air 5 and any water 6 that has inadvertently entered the air entry chamber 123 through the ventilation hole 117 to travel below the ventilation hole 117. The water 6 then exits the boating helmet 100 through the water drainage outlet 121, and the ambient air 5 continues to the cool air opening 125. Once the ambient air 5 reaches the cool air opening 125, it is drawn across the inner surface 142 of the shield 140 to the cool air channel entrance 135, through the cool air channel 136, and to the open shell back 126. By drawing the ambient air 5 that is free of the water 6 across the inner surface 142 of the shield 140, the shield 140 is kept from fogging. It should also be appreciated that the shield 140 protects the user from falling precipitation, water spray, or flying insects.

Figure 6A:
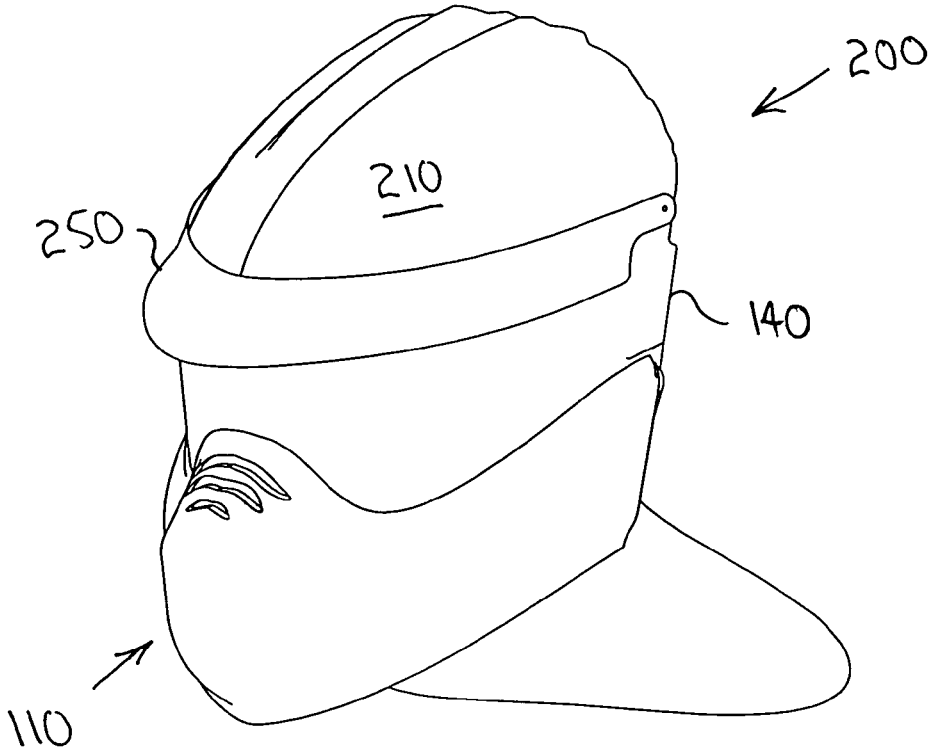
FIG. 6*a* is a front perspective view of a boating helmet according to another embodiment of the present invention shown positioned on a user's head.
Figure 6B:
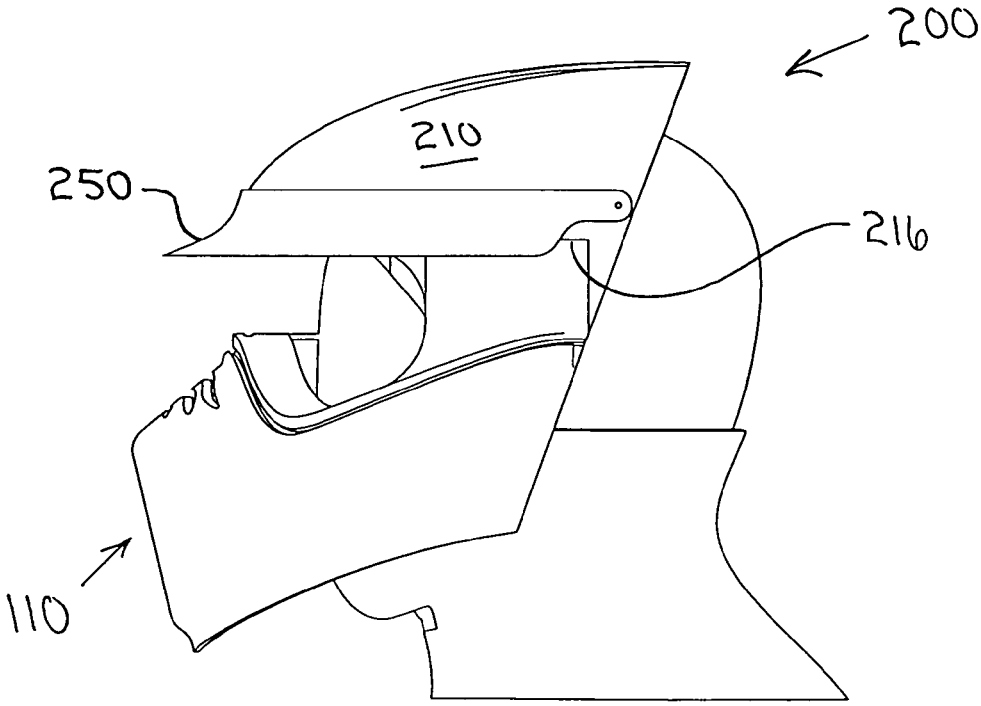
FIG. 6*b* is a side view of the boating helmet as in FIG. 6*a* shown with the shield removed.

A boating helmet 200 according to another embodiment of the present invention is shown in FIGS. 6*a* and 6*b* and includes a construction substantially similar to the construction previously described except as specifically noted below. More particularly, the boating helmet 200 according to this embodiment includes a visor 250 positioned upwardly adjacent an upper edge 216 of the shield opening 116 on an outer surface 210 of the shell 110 for shielding the shield 140 from glare.

It is understood that while certain forms of this invention have been illustrated and described, it is not limited thereto except insofar as such limitations are included in the following claims and allowable functional equivalents thereof.

What is claimed is:

1. A boating helmet, comprising:

a shell having a top portion, opposed side portions, a front portion defining a shield opening and a ventilation hole, and a moisture barrier positioned adjacent a lower edge of said shield opening and extending inwardly;

a transparent shield attached to said shell front portion for covering said shield opening; and a liner nested in said shell and defining a warm air channel for directing warm air from a user's breath away from said transparent shield; wherein, said top portion and said opposed side portions of said shell define an open shell back;

said liner includes an inner surface and opposed left and right ear regions;

said warm air channel includes a left warm air channel extending through said left ear region and a right warm air channel extending through said right ear region;

said left warm air channel extends along said inner surface of said liner from a left warm air channel entrance defined by said liner to said open shell back; and said right warm air channel extends along said inner surface of said liner from a right warm air channel entrance defined by said liner to said open shell back.

2. The boating helmet as in claim 1 wherein:

said moisture barrier defines a cool air opening; and said shell includes an inner wall having an upper edge connected to said moisture barrier and having a lower edge proximate said shell front portion, said lower edge being situated below said ventilation hole and having a configuration forming a water drainage outlet, said inner wall and said shell front portion defining an air entry chamber for directing incoming ambient air from said ventilation hole to said cool air opening and for directing incoming water from said ventilation hole to said water drainage outlet.

3. The boating helmet as in claim 2 wherein said liner includes an inner surface defining a cool air channel in communication with said cool air opening for directing the ambient air from said cool air opening across an inner surface of said shield.

4. The boating helmet as in claim 3 wherein:

said top portion and said opposed side portions of said shell define an open shell back; and said cool air channel extends along said inner surface of said liner for directing the ambient air from said cool air opening to said open shell back.

5. The boating helmet as in claim 1 wherein said liner is constructed of closed cell foam.

6. The boating helmet as in claim 1 wherein said ventilation hole includes a plurality of ventilation holes.

7. The boating helmet as in claim 1 wherein said transparent shield is removably attached to said shell front portion.

8. The boating helmet as in claim 1 further comprising a visor positioned upwardly adjacent an upper edge of said shield opening on an outer surface of said shell for shielding said shield from glare.

9. A boating helmet, comprising:

a shell having:

a top portion, opposed side portions;

a front portion defining a shield opening and a ventilation hole;

a moisture barrier positioned adjacent a lower edge of said shield opening and extending inwardly, said moisture barrier defining a cool air opening;

an inner wall having an upper edge connected to said moisture barrier and having a lower edge proximate said shell front portion, said lower edge being situated below said ventilation hole so as to form a water drainage outlet, said inner wall and said shell front portion defining an air entry chamber for directing incoming ambient air from said ventilation hole to said cool air opening and for directing incoming water from said ventilation hole to said water drainage outlet; and a transparent shield attached to said shell front portion for covering said shield opening.

10. The boating helmet as in claim 9 further comprising a visor positioned upwardly adjacent an upper edge of said shield opening on an outer surface of said shell for shielding said shield from glare.

11. The boating helmet as in claim 9 further comprising a liner nested in said shell, said liner including an inner surface defining a warm air channel for directing warm air from a user's breath away from said transparent shield.

12. The boating helmet as in claim 11 wherein said inner surface of said liner defines a cool air channel in communication with said cool air opening for directing the ambient air from said cool air opening across an inner surface of said shield.

13. The boating helmet as in claim 9 further comprising a liner nested in said shell, said liner including an inner surface defining a cool air channel in communication with said cool air opening for directing the ambient air from said cool air opening across an inner surface of said shield.

14. The boating helmet as in claim 13 wherein:

said top portion and said opposed side portions of said shell define an open shell back; and said cool air channel extends along said inner surface of said liner for directing the ambient air from said cool air opening to said open shell back.

15. The boating helmet as in claim 9 further comprising:

a liner nested in said shell and having opposed left and right ear regions, said liner defining opposed left and right warm air channel entrances;

a left warm air channel defined by said liner extending from said left warm air channel entrance to said left ear region; and a right warm air channel defined by said liner extending from said right warm air channel entrance to said right ear region.

16. The boating helmet as in claim 15 wherein:

said top portion and said opposed side portions of said shell define an open shell back;

said liner defines a cool air channel entrance; and said liner defines a cool air channel extending from said cool air channel entrance to said open shell back, whereby to draw ambient air from said cool air opening across an inner surface of said shield and to said open shell back.

17. The boating helmet as in claim 16 wherein said shell includes an intermediate wall having an upper edge connected to said shell front portion above said ventilation hole and a lower edge positioned in said air entry chamber below said ventilation hole for keeping incoming water from said ventilation hole from reaching said cool air opening.

18. The boating helmet as in claim 9 wherein said shell includes an intermediate wall having an upper edge connected to said shell front portion above said ventilation hole and a lower edge positioned in said air entry chamber below said ventilation hole for keeping incoming water from said ventilation hole from reaching said cool air opening.

19. The boating helmet as in claim 9 wherein said ventilation hole includes a plurality of ventilation holes.

* * * * *